US008402706B2

(12) United States Patent
Fernández Fernández

(10) Patent No.: US 8,402,706 B2
(45) Date of Patent: Mar. 26, 2013

(54) PILLAR PART FOR MODULAR CONSTRUCTION

(75) Inventor: José Javier Fernández Fernández, Ortuella (ES)

(73) Assignee: Habidite, S.A., Ortuella (ES)

( * ) Notice: Subject to any disclaimer, the term of this patent is extended or adjusted under 35 U.S.C. 154(b) by 678 days.

(21) Appl. No.: 12/517,165

(22) PCT Filed: Nov. 30, 2007

(86) PCT No.: PCT/ES2007/000703

§ 371 (c)(1),
(2), (4) Date: Feb. 9, 2010

(87) PCT Pub. No.: WO2008/068366

PCT Pub. Date: Jun. 12, 2008

(65) Prior Publication Data

US 2010/0140447 A1 Jun. 10, 2010

(30) Foreign Application Priority Data

Dec. 1, 2006 (ES) ..... 200603078

(51) Int. Cl.
*E04B 1/04* (2006.01)
*E04B 1/38* (2006.01)
*E04B 2/72* (2006.01)

(52) U.S. Cl. ..... 52/271; 52/439

(58) Field of Classification Search ..... 52/270, 52/271, 220.2, 220.3, 223.7, 439; *E04B 1/343, E04B 1/348*

See application file for complete search history.

(56) References Cited

U.S. PATENT DOCUMENTS

| | | | |
|---|---|---|---|
| 4,059,931 | A | 11/1977 | Mongan et al. |
| 2006/0236627 | A1 | 10/2006 | Messenger et al. |

FOREIGN PATENT DOCUMENTS

| | | |
|---|---|---|
| AU | 638928 | 7/1993 |
| EP | 1 700 964 | 9/2006 |
| JP | 1-214641 | 8/1989 |
| WO | WO 90/10127 | 9/1990 |

*Primary Examiner* — Michael Safavi
(74) *Attorney, Agent, or Firm* — Merchant & Gould P.C.

(57) ABSTRACT

A multi-purpose part (32), comprising: a frusto-conical projection (322') in a lower end INF; a frusto-conical housing (322) in an upper end SUP, arranged to match the frusto-conical housing (322'); a falling mortar pipe (326) extending from the upper end SUP to the lower end INF of the pillar and having, at the lower end (INF), a portion (326") which curves from a downward vertical plane toward a front face of the frusto-conical projection (322') for the introduction of mortar; a rising mortar pipe (327) extending from the lower end INF to the upper end SUP of the pillar and having, at the lower end INF, a portion (327") which is bent from a horizontal plane toward an upward vertical plane so that the mortar introduced rises until a cavity defined by the mortar pipes (326, 327), the frusto-conical housing (322) and the frusto-conical projection (322') is filled.

15 Claims, 6 Drawing Sheets

PILLAR PART FOR MODULAR CONSTRUCTION

This application is a National Stage Application of PCT/ES2007/000703, filed 30Nov. 2007, which claims benefit of Ser. No. P200603078, filed 1 Dec. 2006in Spain and which application are incorporated herein by reference. To the extent appropriate, a claim of priority is made to each of the above disclosed applications.

FIELD OF THE INVENTION

The present invention relates to the field of modular construction systems, based on dwelling modules, roof modules, terrace modules and facade modules which constitute a building from said modules.

BACKGROUND OF THE INVENTION

EP1700964 reveals a modular construction system and a method for leveled assembly of prefabricated construction modules. The modular system consists of heavy-duty concrete construction modules to be vertically stacked and placed one next to the other for the construction of, preferably, residential buildings. Each module forms a monolithic structure or consists of a steel frame and panels with walls, roof and floor. The modules include fitting devices for stacking; lateral connection elements between modules and/or horizontal and vertical clamping straps. Modules are leveled using leveling sheets and/or non-shrink mortar and/or a method using jacks and tubular sections filled with non-shrink mortar until it sets and jacks are withdrawn. Each construction module includes all accessories and finish elements for a house, such as facades, windows, installations, furniture and internal equipment.

DESCRIPTION OF THE INVENTION

The present invention refers to pillars used in dwelling modules, roof modules and buildings built from said modules. Compared to conventional productive systems, it offers innumerable advantages as regards building quality, reduction of environmental impact, work risk prevention, and a drastic reduction on construction time.

One of the main problems in construction is the construction system itself.

Nowadays, it can be said that said process comprises, a succession of more or less crafty works that are constantly affected by external factors that in numerous occasions result in, depending on the case, a worse finish, delays, higher costs and risks, among others.

For that reason, an in-plant production system not only allows a reduction in construction time, risks and unexpected cost increases, but it also allows an execution and finish control similar to that of a mass production factory.

This can be achieved for several reasons:

Tasks are perfectly planned, whereby there are no unexpected situations that may affect production.

Since it is a closed place, it is not affected by meteorological factors, which would result into a waste of time, a decrease in quality, and an increase in costs and risks.

All raw materials that are incorporated into the module previously undergo a pre-assembly process where they are prepared for fitting; this favors optimal working conditions in the pre-assembly zone as well as in the modules, and it also allows a considerable reduction in trims and excess of material.

Likewise, since they are cyclic works in a controlled environment, accidents at work are considerably reduced.

In the manufacturing process, from raw materials, a totally finished fraction of a building, a pillar or a multi-purpose part is obtained, which will be subsequently connected to other modules to form said building.

Said building fractions have the great advantage of incorporating:

partitions, facades, painting, interior and exterior carpentry, cabinets, kitchen with appliances, bathrooms, bathroom accessories, and above all the installations, which include prepared special connection systems located in register boxes for connecting them to adjacent modules.

This form of producing houses represents advantages similar to those of the mass production of any other product, such as automobiles, which allows not only an important reduction in execution time, but also a clear reduction in costs, an spectacular increase in work safety, an important improvement in aspects related to environmental impact and favors the development of a strong industrial base across not only the plant itself, but also across the auxiliary industry, acting as traction head of the economy in its setting up area.

The construction system provides for the manufacture of different elements that form a block of houses in a controlled and stable environment, as an industrial plant is, by a mass production process. Once they are produced, said elements are transported to the place of destination and there the building is permanently assembled.

At the same time, a logical answer adapted to the sociocultural context is offered by a high urban, typological, and esthetic flexibility. The interest lies not only in the fact that construction can be fast with a high degree of quality, but also in that the solution can be adapted to the continuous changes required by the variations in the tendencies and preferences in the field of construction. In this way, the incorporation of building to the market of supply and demand is accomplished.

The buildings developed are the result of the combination of industrialized modules, whose weight and size allow the transportation by conventional means. The modules form dwelling rooms, containing all the necessary installations and finishes for using them.

This construction system allows the development of any building, independently of the use it will contain in its interior, making it possible to adequate the interior setting of the modules for the necessary requirements.

The size, shape and dimension of the building typologies are limited, being exclusively linked to the own rules of a modular combination (the dimensions obtained are multiple of the module smaller dimension). The functional rationality integrated in the design and the different modules shaping, along with the varied combinations thereof, generate multiple distributions.

In the development of residential buildings, the modular combination allows obtaining numerous and varied distributions, with the objective of obtaining in each case the best possible habitability and spatial quality.

The configuration possibilities are very numerous, which may include educational buildings, health centers, hotels, residences, and penitentiary centres.

As an example, as regards dwelling modules, it is possible to generate from single room apartments to single-family buildings, including dwelling modules with as many bedrooms as it is wanted, having also the chance of choosing varied kitchen configurations (American or independent) and the opportunity of including or choosing among varied complementary spaces (toilet, dressing room, back room, working area, and others) by the connection of as many modules as necessary.

All building configurations arise from simple and comfortable distributions that facilitate the functioning and every day use, solving by the design itself the placement of cabinets, storage solutions and optimum appliances location.

The dwelling modules are complemented with others intended for terrace, elevator holes, stairs, receiving areas or decks, to form the building as a whole, having already all the integrated installations from factory, such as plumbing system, electrical installation, home automation, heating system, air conditioning system, and others.

In this way, what can be called the final product is the building totally fabricated from the floor, finished and ready to be handed over to its future tenants in perfect usage and habitability conditions.

For that reason, different totally in-plant constructed modules were conceived, in such a way that after the production process they are shipped to the destination place and are finally assembled with the appropriate auxiliary means.

The building structure up to the zero level (garages, basement, storefronts, foundation, and others) is fabricated in situ, on-site. This is made with the habitual methods used in construction.

The complete units may be of three main different types: dwelling modules, terrace modules and roof modules. The first two refer to the living spaces intended for dwelling, while the third group includes the plates acting as the crowning of the building.

Furthermore, there exist other elements that take part during assembly, such as those of the prefabricated structure (beams and pillars) of the zero level on top of which the first floor rests. There follows a description of module types and other components of the invention:

Dwelling Modules

Dwelling modules have a parallelepiped rectangular geometry, that is to say, large dimension rectangular prisms, made into modules so that they may be combined into several varied typological forms.

The main bearing structure consists of a horizontal sole plate, four vertical pillars on the corners thereof, four top perimeter beams and a slab supported thereon as a roof.

Said lower sole plate is formed by a horizontal slab supported on three longitudinal (pre-stressed or post-stressed) and two cross beams, which mainly bears the load of the interior of the house. Together with this sole plate, the other beams and pillars form the module frame, which in turn is braced by the perimeter and internal partition walls, which form the distributions of the house. Said walls work as large plates for transmitting horizontal loads and provide the whole structure with more rigidity and firmness.

Each pillar has an embedded Pillar Multi-purpose part (PMP), that is, 4 PMP in each module. This piece is described below.

Finally, the roof is a slab, also prefabricated, but it is manufactured separately and it is added afterwards so as not to interfere with the stages of production and interior finishing. This slab is supported on the cut made on the upper perimeter beams. In order to keep the air tightness, there are three options:

Placing a section made of a polymer material that is anchored to other metal sections embedded into the concrete.

Sealing the entire union surface with a silicone cord.

Making this seal with mortar.

The dwelling module types are basically three:

1. Corner modules
2. Facade modules
3. Interior modules

Corner modules are those in which two facade walls converge at 90°; the second modules have only a facade wall, with the other faces of the parallelepiped inside the building; and the third modules are those that have no facade faces.

The stairs, corridors, elevators, doorways and the other common use elements inside the residential building are also formed with dwelling modules, that is, the whole building is made up of modules.

Pillar Multi-Purpose Part

The key piece allowing the correct assembly is the Pillar Multi-purpose part, PMP. The PMP has 3 parts:

1. Top part: In the top part there is a cone that supports the upper module of the PMP, there are center cups (for the lateral screwed unions and the anchoring of facades and balconies) and there is a leveling screw that also serves as a coupling for the lifting tool. The lower part of the cone, in the metallic plate, has 3 holes; one for the leveling screw (and stem), another circular one through which the mortar joining the upper and the lower cones is introduced and another square one (air outlet) whereby the mortar rises and closes the circuit. In the upper part there are also some corrugated bars welded to the metallic plate serving as anchorage to secure the PMP to the concrete pillar.

2. Central part: It is the interconnection between the upper cone and the lower cone. It is formed by 2 circular pipes and a central tubular square.

The central one contains the leveling stem, and the 2 lateral pipes are used to make the mortar communicate the 2 cones. This part of the PMP is divided into 2 parts, since the concreting process is carried out in two stages: first the sole plate and then the elevations (pillars, upper beams and walls).

Thus, the lower section of said jacket ends with a wider pipe so that the second section of the jacket is coupled thereto. In this second section, some fixing stops are placed so as to create a clearance between the two sections, which lets the stem go up and down. This in turn has some other stops that prevent the stem from falling and going out of the pillar during the lifting of the module. A similar coupling is made with the mortar filling pipe and the air outlet pipe, which have a coupling mouthpiece to ensure the continuity thereof.

3. Lower part, or lower cone, is the part that is coupled to the upper cone of the lower module PMP. It is perforated by 3 holes, which is the place where the mortar conducting pipes and the metallic jacket, where the central stem is housed, end.

As it has been indicated, in every pillar a Pillar Multi-purpose part, PMP, is inserted, which basically has six functions:

1. Lifting:

The upper screw of the PMP is used to couple a special lifting tool to lift the module for transporting it.

2. Approaching:

The fact that the lower and upper ends of the PMP are conic is essential to achieve an approaching as tight as possible when assembling one module on top of the other. It is the form of the supporting module cones itself that directs each of those four points until they are placed exactly on the conic holes of the lower module. A perfect tongue and groove connection is obtained, which ensures that both pieces are perfectly aligned in plant.

3. Embedment:

This support design, allows an embedding among modules that restrains any involuntary movement of one module with respect to the other, since the horizontal and vertical movements are constrained. This embedding between pieces is implemented by the inclusion of heavy-duty mortar between the supporting cone of the upper module and the conic hole of the lower one; said mortar is introduced from the upper conic hole and flows, through the filler pipe, down the pillar; in this way the clearance between the conic support and the conic hole is filled ensuring no air enters, which is achieved thanks to another outlet pipe that expels, upwardly, any air bubble.

In order to prevent mortar from being accidentally introduced into the pipe intended for the extraction of air, the open end of the mortar pipe has a circular design for the introduction funnel to perfectly couple therein; on the other hand, the other pipe outlet is square and smaller, so as to prevent the operator from accidentally connecting the funnel therein.

In order to prevent mortar from spreading beyond the strictly necessary area, some flexible plastic rings are provided around the supporting cones, as a barrier, to prevent the fluid from being uncontrollably introduced. Furthermore, in order to facilitate the mortar's filling the holes left between both modules, the stem includes in its lower area a groove to allow the mortar flow inside the orifice of the perforated plate of the lower module.

The introduction of the mortar is made once the module leveling has been carried out.

4. Leveling:

The advantage of the system is that said leveling can be carried out from the upper area of the module, which on the one hand prevents going into the interior thereof and on the other hand facilitates and makes the assembly process more comfortable. The leveling is obtained by the leveling screw, placed in the upper conic hole, and fixed to the perforated metallic plate with a thread. When said screw is fastened, it pushes the central stem that goes across the whole pillar and that is inserted into the metallic jacket to make its movement independent from the rest of the structure. Said vertical pushing makes the module rise from that corner; similarly, if the screw is unfastened, it is possible to make the module slightly descend from that corner instead of rising. Given that said margin of movement is provided in each of the four PMP of a module, it can be perfectly leveled without any restriction.

5. Binding:

When all modules of a same plant are perfectly placed and leveled, the binding of the modules at the head by pre-stressed screws in the cup and heavy-duty mortar is introduced in the joints thereof. First, concrete is introduced through the PMP into the hole between the supporting cone and the conic hole, and then the introduction between the dap joints of the wet joints between the interior pillars is made.

6. Fixing of facades and balconies:

The PMP incorporates cups that apart from joining the modules, also serve for joining the facade panels or terrace modules.

In the assembly process, the lifting is generally carried out with a crane, using balance beams that ensure the horizontal position of modules at all times. Said balance beams are metallic frames whose coupling points draw a homothetic rectangle in the plant of each module. The fastening to the corners thereof is carried out by means of the lifting tool in each of the PMP.

Once on-site, and after the unpacking of the merchandise, the assembly of the modules follows a process that can be simplified as follows:

a) Lifting and Placement

Each module fits perfectly with the one under it (or with the supporting beams of the first plant, if that were the case). In this way, in-plant placement is accurate and perfect. For the lifting of the dwelling and roof modules a special lifting tool is used. This tool has been specifically designed to couple to the upper cone of the PMP of the dwelling and roof modules, coupling itself to the leveling screw that is screwed to the metallic plate of the PMP.

The main body has an end to which the slings or lifting chains are coupled. This body includes a small lever surrounded by a main spring. The turning of the small lever activates the upward vertical movement of the moving body compressing the main spring, and laterally moving the embedding elements, which will make the 4 secondary springs be loosened according to the turning of the small lever.

In a normal condition, the main spring is relaxed, and the position of the small lever keeps the moving body in its lower possible position. This position keeps the embedding elements apart from one other, and the secondary springs forced.

In the embedding elements when extended, that is to say in a normal condition, the perfect contact with the inclined surface of the PMP prevents the tool from slanting keeping it always in vertical position, which is essential for the screw of the PMP not to bend and accomplish its subsequent leveling mission. Besides, its position makes it impossible for the device to clamp the screw head.

When the small lever is turned by an operator, it moves the moving body upwards, what makes the secondary springs return to their normal condition joining the embedding elements. This turn makes it possible for the device to be introduced in the screw of the PMP. When the operator releases the lever, the main spring tends to loosen, which shifts the lever, generating the movement of the moving body to its lower position making the system return to its normal condition, gripping the screw head of the PMP.

In short, the lifting of the module by its four corners is obtained, said corners anchoring to the PMPs by their leveling screws.

This system has the following advantages:

Once it clamps the screw it is impossible that it can be opened during the transporting operations.

The device can neither be unwillingly released, nor be incorrectly placed.

Apart from embedding into the stem and the screw head, it also presses the inclined surfaces of the cone of the PMP avoiding plays and horizontal thrusts provoking the bending of the screw of the PMP.

b) Leveling

In case it were necessary to level the module, which should be checked by topographic means, said verification would be carried out as explained with reference to the PMP; that is to say, each module would be leveled from its upper part by clapping or loosening the leveling screw.

c) Connection Concreting

The connections between the dwelling modules are of three different types:

Vertical connection;

Horizontal connection in pillar head;

Horizontal connection in pillar face.

Vertically, modules are supported ones on the others thanks to the functions of the Pillar Multi-purpose part, which were explained above.

The horizontal connection is made in two ways: by a mechanical binding at the pillar head using screws that fix together the cups of the PMPs of two parallel modules (or independent cups embedded in the center of a longitudinal beam in the case of perpendicular modules), and by a wet joint created in the face of the pillar that is left between two pillars of two contiguous modules facing each other.

Said joint is formed by the space created by two dap joints, one in the pillar of each module, one facing the other; so that, it is generated a vertical space through which, after placing the modules in their exact position, the two pillars are integrated; this is accomplished by introducing heavy-duty mortar that vertically fills said hole between the flexible reinforcing bars of the dap joints, thus assembling both pillars. Parallel to the sides of the dap joints, from top to bottom, hermetic bands are left embedded in the pillar to prevent said mortar from flowing out of the vertical strip that is to be filled. With these two horizontal connections more structural rigidity is obtained for the whole building structure, when working with traction, horizontal shear and vertical shear.

As regards the unions between the roof modules, for the horizontal connections apart from the mechanical screwing through the cups of the PMP, some coping stones with housings to mechanically fix the sun plates will be also used.

As regards the union between Dwelling modules and Terrace modules, the anchoring between both modules will be made by screws, as it was mentioned above.

In this way, both modules are factory-assembled.

d) Exterior Butt Joints

In order to prevent water or air from entering through the upper separations of the modules, and to assure the dwellers of the house that it will not be affected by water leaks in the upper plants, leak-tight rubber seals are installed, which, coupled to the embedded sections of the beams, manage to provide each house and each plant with a hermetic seal. Said butt joints drive any moisture to the areas connected to the down pipes, placed where four pillars meet, so as to prevent water from stagnating between the plants.

e) Withdrawal of Screws

Once the mortar has set and it can be guaranteed that it has the necessary strength, the leveling screws are loosened, having now no function whatsoever since the modules rest on the hardened mortar.

f) Connection of Installations

Although it is possible to couple the installations connections when the assembly of a plant is finished, in certain cases, it is recommended waiting until the whole building is assembled. Said joints, made in logs which are covered or out of sight, are fast joints, by means of coupling sleeves, flexible connectors, direct connections, and other types of unions.

g) Interior Butt Joints

Finally, the internal esthetic finishes that are used to camouflage or hide the unavoidable joints between modules, in partitions as wells as on the floor and roof, are installed from the interior of the living areas.

After the description of the invention, it can be appreciated that it presents a series of advantages over closer prior art drawbacks, where the module has basically two main components or materials: concrete and metal ribs.

The document cited in the background of the invention makes no reference to the transportation modules, where each of the said modules would have a weight of about 40 T. In said document, no reference is made as to how to lift the modules, or from where the modules are coupled for their subsequent transportation and fitting. In the same way, there is no description of the terrace connection system.

On the other hand, the assembly of the modules requires auxiliary systems for their leveling, such as the hydraulic jacks and mortar filling systems.

Vis-à-vis these inconveniences, the present invention proposes a modular construction system of a whole building comprising decks and terraces. The dwelling modules have an independent roof, which facilitates the module installation.

The weight of the living module of the invention is 24 T, so they can be transported by means of conventional methods.

The construction system is simple, since the connection guiding, embedding, fixing and leveling is made by the PMP.

The assembly is also simpler, because it only requires introducing mortar through the PMPs and into the dap joints; there is no need of any auxiliary systems such as hydraulic jacks or others.

The system of connections of the present invention provides the finished building with a more monolithic nature.

BRIEF DESCRIPTION OF THE DRAWINGS

The following is a brief description of a series of drawings which will help understand the invention better, clearly relating to an embodiment of said invention which is presented as a non-limiting example thereof.

DESCRIPTION OF A PREFERRED EMBODIMENT OF THE INVENTION

Figure 1A:
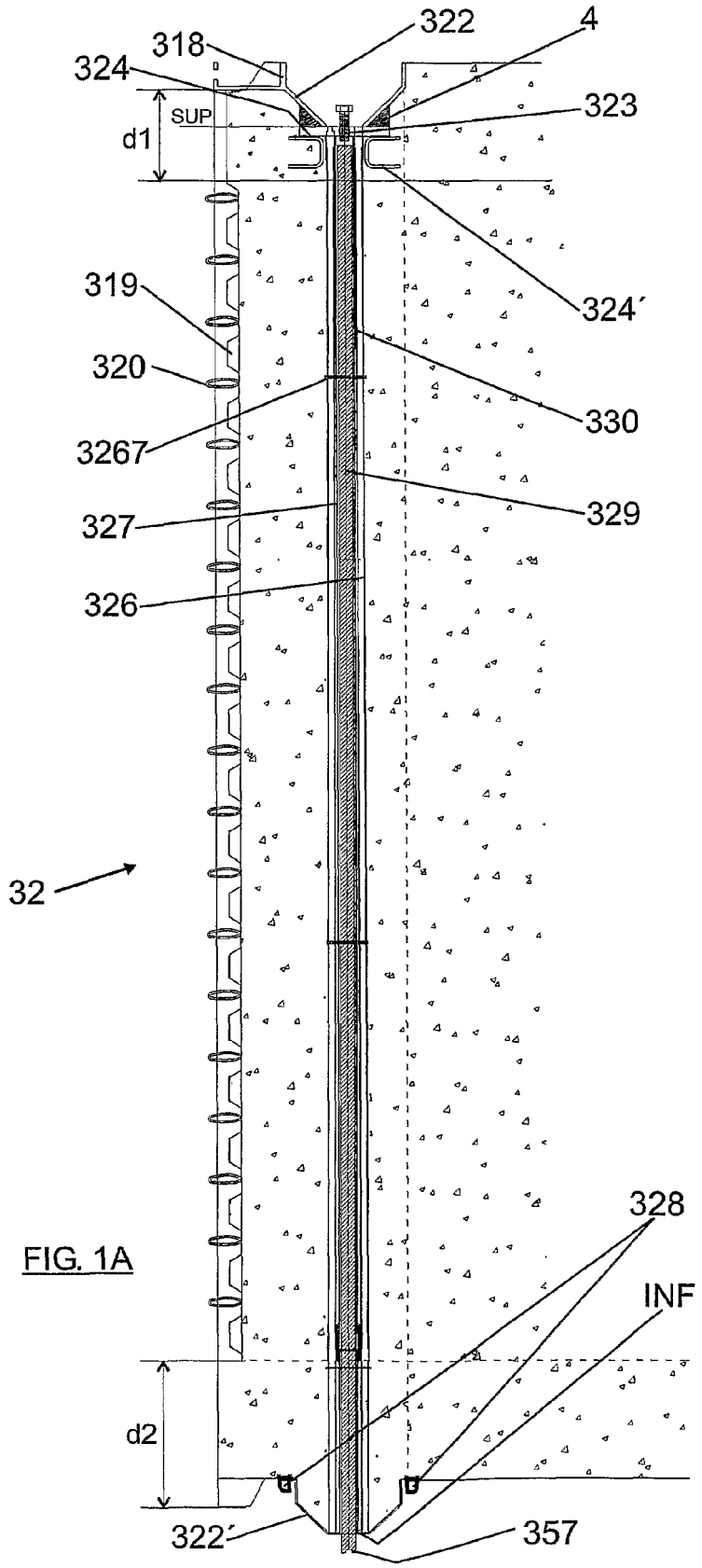
FIG. 1A is a longitudinal section of the pillar that shows a first embodiment of the multi-purpose part that has the falling mortar pipe, the rising mortar pipe, the pipe clamp, the central stem, the vertical jacket and other elements of the pillar.
Figure 1B:
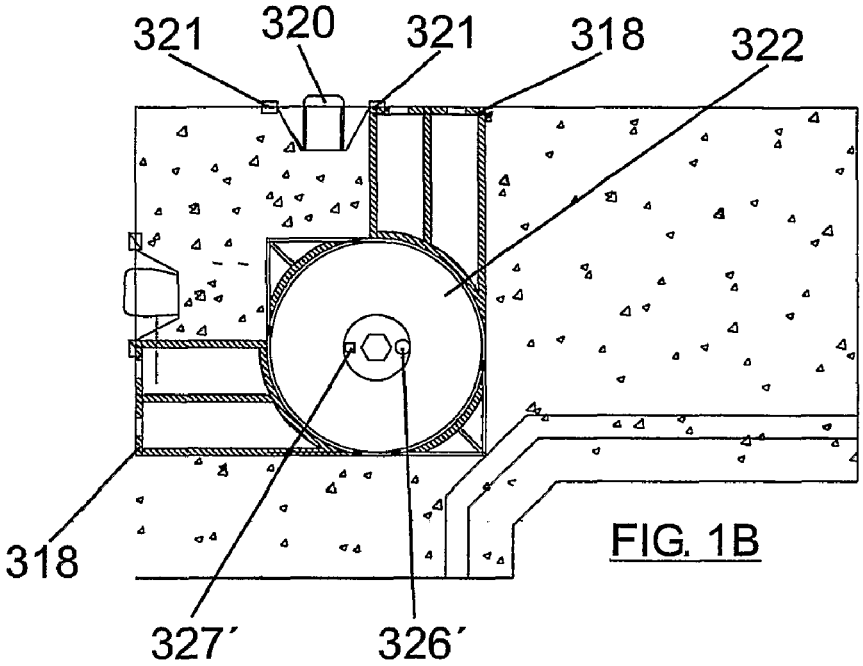
FIG. 1B is a plan view of a first embodiment of the pillar that shows the top part of the multi-purpose part.
Figure 1C:
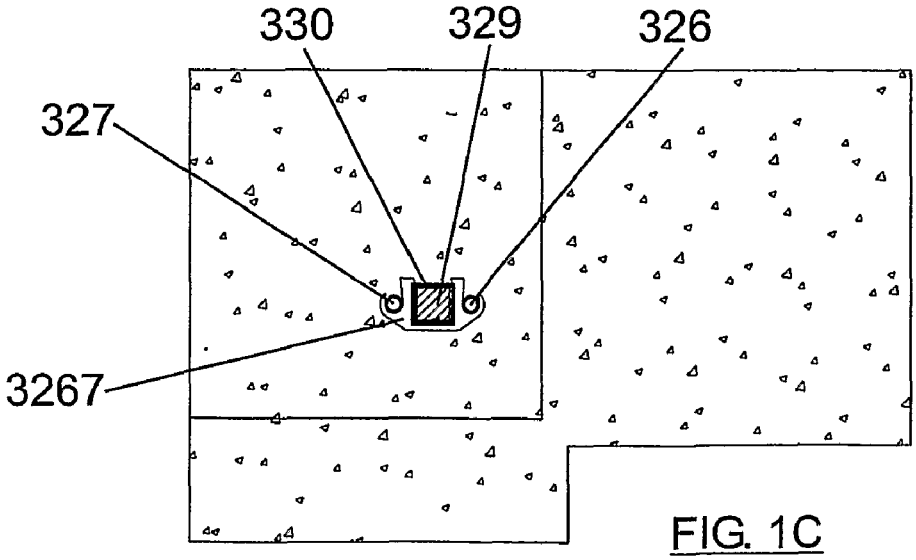
FIG. 1C is a cross section of a first embodiment of the multi-purpose part that shows the clamping of the upward and falling mortar pipes to the vertical jacket of the central stem.
Figure 1D:
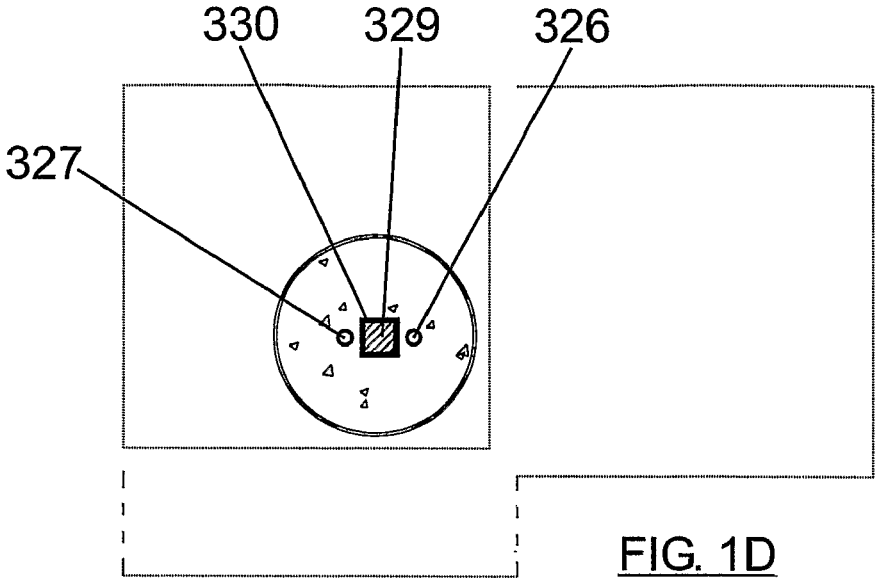
FIG. 1D is a cross section of the pillar that shows the lower part of a first embodiment of the multi-purpose part.
Figure 1E:
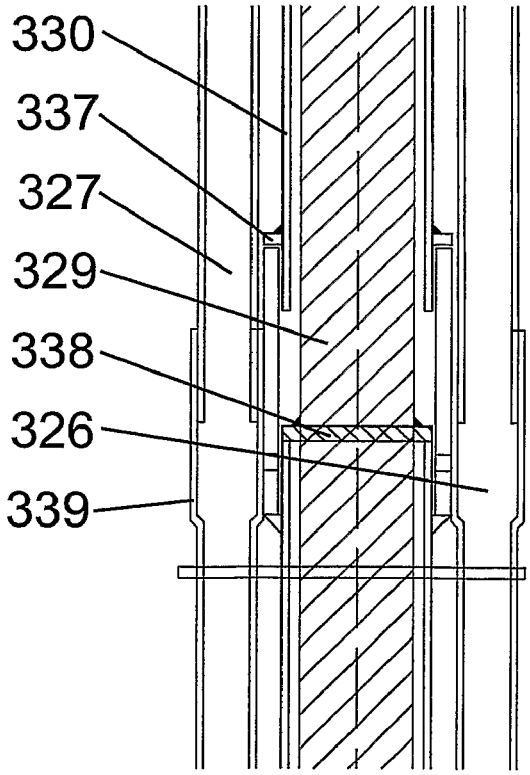
FIG. 1E is a detailed view of the central part of a first embodiment of the multi-purpose part.
Figure 2A:
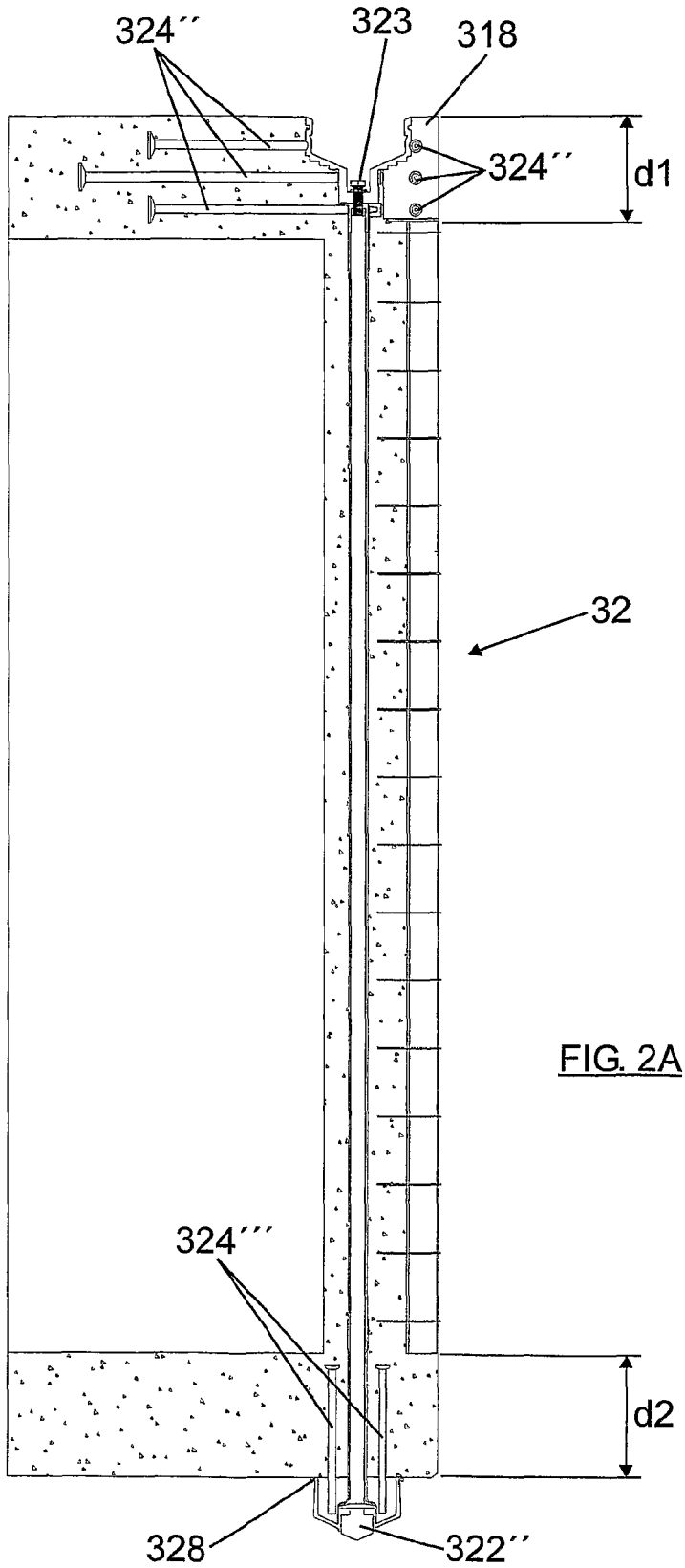
FIG. 2A is a longitudinal section of the pillar that shows a second embodiment of the multi-purpose part.
Figure 2B:
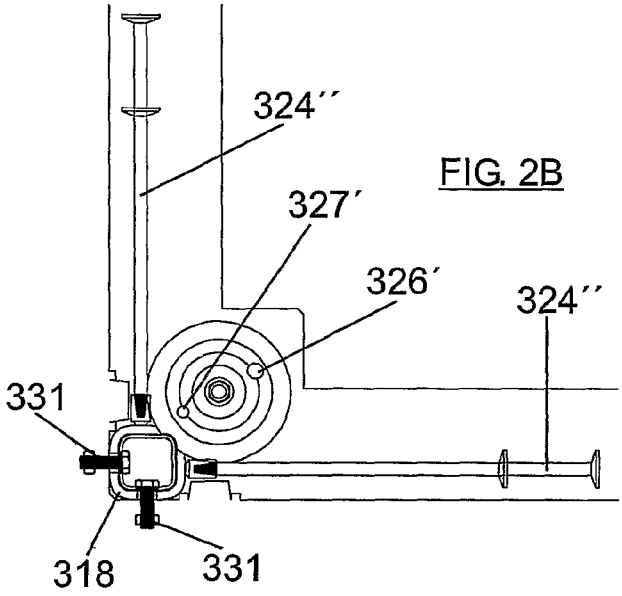
FIG. 2B is a plan view of the second embodiment of the pillar that shows the top part of the multi-purpose part.
Figure 2C:
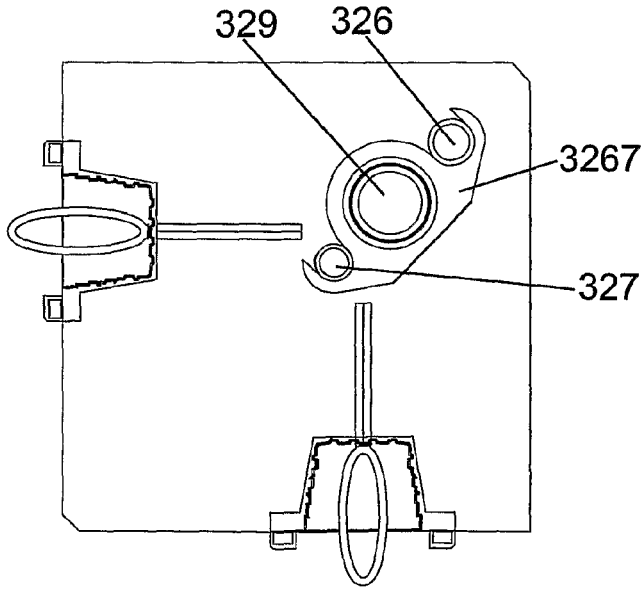
FIG. 2C is a cross section of a second embodiment of the multi-purpose part that shows the clamping of the upward and falling mortar pipes to the vertical jacket of the central stem.
Figure 2D:
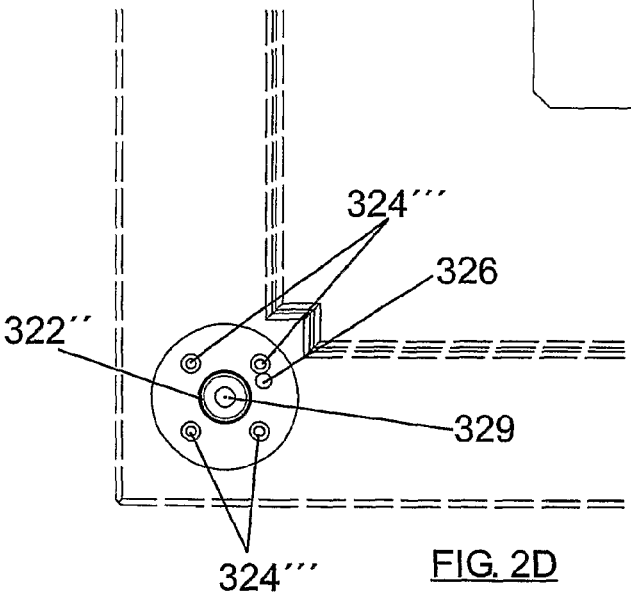
FIG. 2D is a cross section of the pillar that shows the lower part of a second embodiment of the multi-purpose part.
Figure 2E:
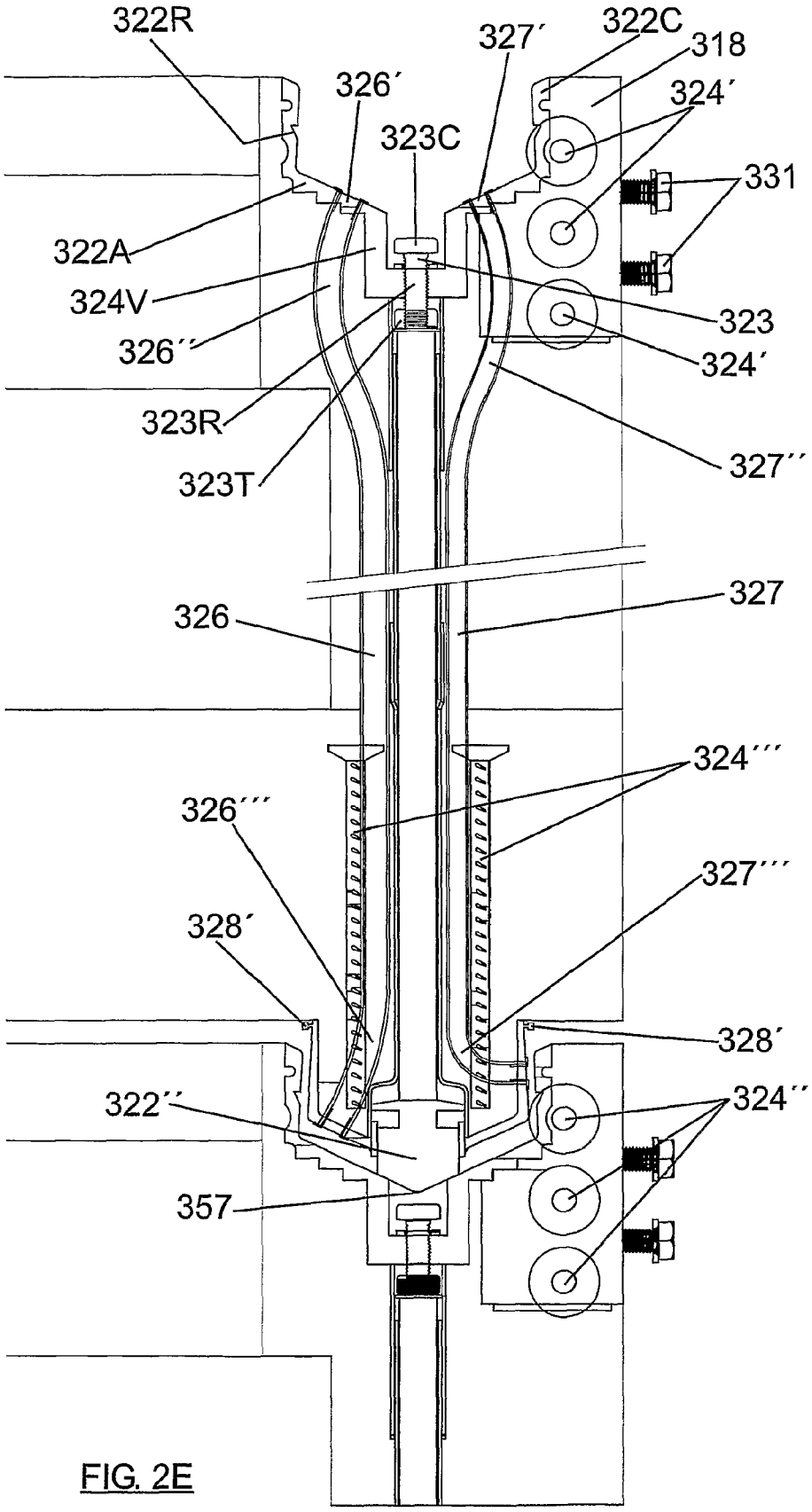
FIG. 2E is a longitudinal section of the pillar that shows the upper and lower ends of a second embodiment of the multi-purpose part where the rising mortar pipe, the falling mortar pipe and other elements of the pillar are shown.

1. A first embodiment of the invention refers to a multi-purpose part (32) comprising:

a frusto-conical projection (322') in a lower end INF;

a frusto-conical housing (322) in an upper end SUP, arranged to match the frusto-conical projection (322') and facilitate the stacking and fitting of a module on top of the other by means of a tight approach and a tongue and groove connection secured by an alignment of both modules in-plant;

a falling mortar pipe (326) extending from the upper end SUP to the lower end INF of the pillar for the introduction of mortar;

a rising mortar pipe (327) extending from the lower end INF to the upper end SUP of the pillar so that the mortar introduced rises until a cavity defined by the mortar pipes (326, 327), the frusto-conical housing (322) and the frusto-conical projection (322') is filled.

2. This multi-purpose part (32) may also comprise:

a central stem (329) from the upper end SUP to the lower end INF, to transmit a regulated leveling by means of a leveling screw (323) to a module, comprising said stem a groove (357) in the lower end INF to allow a mortar flow;

a vertical jacket (330) covering the central stem (329);

at least one pipe clamp (3267) to secure the pipes (326, 327) to the vertical jacket (330) between the upper end SUP and the lower end INF.

The central part of the multi-purpose part (32) is the intercommunication device between the upper cone and the lower cone. It is formed by 2 circular pipes and a central tubular square (330).

The central tubular square (330) contains the leveling stem (329), and the 2 side pipes (326, 327) are used to make the mortar communicate the 2 cones. This part of the PMP is divided into 2 parts, since the concreting process is carried out in two stages: first the sole plate and then the elevations (pillars, top beams and walls).

Thus, the lower section of said jacket ends in a wider pipe so that the second jacket section be coupled thereto. In this second section, some fixing stops (337, 338) are placed so as to create a clearance between the two sections, which lets the stem go up and down. This in turn has other stops that prevent the stem from falling and going out of the pillar during the lifting of the module. A similar coupling is made with the mortar filler pipe and the air outlet pipe, which have a coupling mouthpiece (339) to ensure the continuity thereof.

3. Additionally, the multi-purpose part (32) may also comprise in the upper end SUP:

a big perforated metal plate (324) comprising:

- a first central threaded hole arranged to receive a leveling screw (323);
- a second hole (326') that coincides with the falling mortar pipe (326);
- a third hole (327') that coincides with the rising mortar pipe (327);

a first corrugating (324') embedded into the pillar and welded to the perforated metal plate (324).

4. Likewise, in the multi-purpose part (32)

the second hole (326') may have a round form arranged to receive a mortar filler funnel;

the third hole (327') may have a square form and a dimension smaller than the second hole (326') to prevent a mortar filler funnel from being coupled to the third hole (327').

5. The multi-purpose part (32) may also comprise in the lower end INF a plurality of flexible plastic rings, deformable and expansive (328) to prevent a mortar overflow and ensure a hermetic coupling between the frusto-conical projection (322') and the frusto-conical housing (322).

6. Additionally, the multi-purpose part (32) may also comprise first horizontal fixing means comprising:

at least one perforated cup (318) in an upper end SUP arranged to receive fixing screws (331) that couple to a cup (318) of an adjacent multi-purpose part (32) to horizontally join two modules as well as to hang prefabricated terrace and facade modules.

7. Likewise, the multi-purpose part (32) may comprise in the upper end SUP:

a metal frusto-conical plate (322) comprising:

- a smaller diameter in contact with the big perforated metal plate (324), containing a diameter smaller than the second hole (326') and the third hole (327');
- a larger diameter between the edge of the upper end SUP and the smaller diameter, to define the frusto-conical housing (322).

8. Likewise, the multi-purpose part (32) may also comprise in the upper end SUP:

a plurality of bridging plates (4) between the perforated metal plate (324) and the frusto-conical housing (322).

9. A second embodiment of the multi-purpose part (32) comprises:

a frusto-conical projection (322') in a lower end INF;

a frusto-conical housing (322) in an upper end SUP, arranged to match the frusto-conical projection (322') and facilitate the stacking and fitting of one module on top of the other by means of a tight approach and a tongue and groove connection secured by an alignment of both modules in-plant;

a falling mortar pipe (326) extending from the upper end SUP to the lower end INF of the pillar, having, at the lower end INF, a curved portion (326") from a downward vertical plane toward a front face of the frusto-conical projection (322') for the introduction of mortar;

a rising mortar pipe (327) extending from the lower end INF to the upper end SUP of the pillar and having, at the lower end INF, a bent portion (327") from a horizontal plane toward an upward vertical plane so that the mortar introduced goes up until a cavity defined by the mortar pipes (326, 327), the frusto-conical housing (322) and the frusto-conical projection (322') is filled.

10. This multi-purpose part (32) may also comprise:

a central stem (329) extending from the upper end SUP to the lower end INF, to transmit a regulated leveling by means of a leveling screw (323) to a support part (322");

a vertical jacket (330) covering the central stem (329);

at least one pipe clamp (3267) to secure the pipes (326, 327) to the vertical jacket (330) between the upper end SUP and the lower end INF;

a support part (322") housed in a frusto-conical projection (322'), the central stem (329) resting on a support part (322"), the support part (322") comprising a groove (357) in the lower end INF to allow a mortar flow.

11. The frusto-conical housing (322) of the multi-purpose part (32) may comprise:

a cylindrical metal vase (324V) comprising:

- a first central threaded hole arranged to receive and keep a leveling screw (323), the leveling screw (323) comprising:
  - a threaded portion (323R) to be tightened/loosened in the first central threaded hole and allow a leveling;
  - a head (323C) to tighten/loosen the screw (323);
  - a retention nut (323T) welded to an end opposite to the head (323C), arranged so that the screw (323) is kept in the first central threaded hole;
- a frusto-conical metal plate portion (322A) on the cylindrical vase (324V), the frusto-conical portion (322A) comprising:
  - a second hole (326') connecting with the falling mortar pipe (326), the falling mortar pipe (326) comprising a curved portion (326") from the second hole (326') in the front face of the frusto-conical metal plate (322A) toward a downward vertical plane;
  - a third hole (327') connecting with the rising mortar pipe (327), the rising mortar pipe (327) comprising a curved portion (327") from an upward vertical plane toward the third hole (327') in the front face of the frusto-conical metal plate (322A);
- a cylindrical portion (322C) comprising a perimeter groove of triangular section (322R) along the whole wall of the cylindrical portion (322C), arranged to house a plurality of claws of a lifting tool that is used as lifting and moving system.

12. In the multi-purpose part (32):

the second hole (326') may have a round form arranged to receive a mortar filler funnel;

the third hole (327') may have a round form and a diameter smaller than the second hole (326') to prevent a mortar filler funnel from being coupled to the third hole (327').

13. The multi-purpose part (32) may also comprise in the lower end INF a plurality of flexible plastic rings (328), attached to a T section (328'), to prevent a mortar overflow and to ensure an hermetic coupling between the frusto-conical projection (322') and the frusto-conical housing (322).

14. The multi-purpose part (32) may also comprise first horizontal fastening means comprising:

at least one perforated cup (318) in an upper end SUP arranged to receive fixing screws (331) coupled to a cup (318) of an adjacent multi-purpose part (32) to horizontally join two modules as well as to hang prefabricated terrace and facade modules;

a second corrugating (324') embedded into the pillar and welded to the perforated cup (318).

15. The frusto-conical portion (322A) may comprise:

a smaller diameter in contact with the cylindrical vase (324V);

a larger diameter between the edge of the upper end SUP and the smaller diameter, to define the frusto-conical housing (322);

the second hole (326') and the third hole (327') contiguous to the smaller diameter.

16. The multi-purpose part (32) may also comprise in the lower end INF:

a metal reinforcement (324''') embedded into the pillar and welded to the frusto-conical projection (322').

The invention claimed is:

1. A multi-purpose part comprising:

a frusto-conical projection in a lower end;

a frusto-conical housing in an upper end, arranged to match the frusto-conical projection and facilitate stacking and fitting of a first module on top of a second module by a tight approach and a tongue and groove connection secured by an alignment of the first module and the second module;

a falling mortar pipe extending from the upper end of a pillar to the lower end thereof for the introduction of mortar;

a rising mortar pipe extending from the lower end of the pillar to the upper end thereof so that the mortar introduced rises until a cavity defined by the mortar pipes, the frusto-conical housing and the frusto-conical projection is filled.

2. Multi-purpose part according to claim 1, further comprising:

a central stem extending from the upper end to the lower end, to transmit a regulated leveling by means of a leveling screw to a module, said stem comprising a groove in the lower end to allow a mortar flow;

a vertical jacket covering the central stem;

at least one pipe clamp to secure the pipes to the vertical jacket between the upper end and the lower end.

3. Multi-purpose part according to claim 1, further comprising in the upper end:

a perforated metal plate comprising:

a first central threaded hole arranged to receive a leveling screw;

a second hole that coincides with the falling mortar pipe;

a third hole that coincides with the rising mortar pipe;

a first corrugating metallic profile embedded into the pillar and welded to the perforated metal plate.

4. Multi-purpose part according to claim 3, wherein the second hole has a round form arranged to receive a mortar filler funnel;

the third hole has a square form and a dimension smaller than the second hole to prevent a mortar filler funnel from being coupled to the third hole.

5. Multi-purpose part according to claim 1, further comprising in the lower end a plurality of flexible plastic rings to prevent a mortar overflow and ensure a hermetic coupling between the frusto-conical projection and the frusto-conical housing.

6. Multi-purpose part according to claim 1, further comprising first horizontal fastening means comprising:

at least one perforated cup in an upper end arranged to receive fixing screws that couple to a cup of an adjacent multi-purpose part to horizontally join two modules as well as to hang prefabricated terrace and facade modules.

7. Multi-purpose part according to claim 3, further comprising in the upper end:

a metal frusto-conical plate comprising:

a first portion in contact with the perforated metal plate, the first portion having a first diameter smaller than a second diameter of a second portion, the second portion containing the first portion, the second hole and the third hole;

the second portion being disposed between the edge of the upper end and the first portion, to define the frusto-conical housing.

8. Multi-purpose part according to claim 7, further comprising in the upper end:

a plurality of bridging plates between the perforated metal plate and the frusto-conical housing.

9. Multi-purpose part comprising:

a frusto-conical projection in a lower end;

a frusto-conical housing in an upper end, arranged to match the frusto-conical projection and facilitate stacking and fitting of a first module on top of a second module by a tight approach and a tongue and groove connection secured by an alignment of the first module and the second module;

a falling mortar pipe extending from the upper end to the lower end of a pillar and having, at the lower end, a portion which curves from a downward vertical plane toward a front face of the frusto-conical projection for the introduction of mortar;

a rising mortar pipe extending from the lower end to the upper end of the pillar and having, at the lower end, a portion which is bent from a horizontal plane toward an upward vertical plane so that the mortar introduced rises until a cavity defined by the mortar pipes, the frusto-conical housing and the frusto-conical projection is filled.

10. Multi-purpose part according to claim 9, further comprising:

a central stem extending from the upper end to the lower end, to transmit a regulated leveling by means of a leveling screw to a support part;

a vertical jacket covering the central stem;

at least one pipe clamp to secure the pipes to the vertical jacket between the upper end and the lower end;

a support part housed in a frusto-conical projection, the central stem resting on the support part, the support part comprising a groove in the lower end to allow a mortar flow.

11. Multi-purpose part according to claim 9, wherein the frusto-conical housing comprises:

a cylindrical metal vase comprising:

a first central threaded hole arranged to receive and keep a leveling screw, the leveling screw comprising:

a threaded portion to be tightened/loosened in the first central threaded hole and allow a leveling;

a head to tighten/loosen the screw;

a retention nut welded at an end opposite to the head, arranged so that the screw is kept in the first central threaded hole;

a frusto-conical metal plate portion on the cylindrical vase, the frusto-conical portion comprising:

a front face having a second hole connecting with the falling mortar pipe, the falling mortar pipe comprising, a falling mortar pipe portion curving from the second hole to a first vertical pipe of the falling mortar pipe;

a third hole in the front face of the frusto-conical metal plate connecting with the rising mortar pipe, the rising mortar pipe comprising, a rising mortar pipe portion curving from a second vertical pipe of the rising mortar pipe to the third hole;

a cylindrical portion comprising a perimeter groove of triangular section along the whole wall of the cylindrical portion, arranged to house a plurality of claws of a lifting tool.

12. Multi-purpose part according to claim 11, wherein:

the second hole has a round form arranged to receive a mortar filler funnel;

the third hole has a round form and a smaller diameter than the second hole to prevent a mortar filler funnel from being coupled to the third hole.

13. Multi-purpose part according to claim 9, further comprising in the lower end a plurality of flexible plastic rings, attached to a T section, to prevent a mortar overflow and to ensure a hermetic coupling between the frusto-conical projection and the frusto-conical housing.

14. Multi-purpose part according to claim 9, further comprising first horizontal fastening means comprising:

at least one perforated cup in an upper end arranged to receive fixing screws coupling to a cup of an adjacent multi-purpose part to horizontally join two modules as well as to hang prefabricated terrace and facade modules;

a first corrugating metallic profile embedded into the pillar and welded to the perforated cup.

15. Multi-purpose part according to claim 11, wherein the frusto-conical portion comprises:

a first portion in contact with the cylindrical vase and a second portion;

the first portion having a first diameter smaller than a second diameter of the second portion;

the second portion being disposed between the edge of the upper end and the first portion, to define the frusto-conical housing;

the second hole and the third hole contiguous to the first portion.

* * * * *